United States Patent [19]

Krishnakumar et al.

[11] Patent Number: 4,981,023

[45] Date of Patent: Jan. 1, 1991

[54] AIR CONDITIONING AND HEAT PUMP SYSTEM

[75] Inventors: C. K. Krishnakumar, Lombard; Clyde K. Schafer, Glendale Heights, both of Ill.

[73] Assignee: Innovative Products, Inc., Lombard, Ill.

[21] Appl. No.: 378,044

[22] Filed: Jul. 11, 1989

[51] Int. Cl.[5] ..... F25B 1/00

[52] U.S. Cl. ..... 62/498; 62/117; 62/196.1; 62/500

[58] Field of Search ..... 62/500, 512, 324.1, 62/196.1, 117, 498, 513

[56] References Cited

U.S. PATENT DOCUMENTS

| | | | |
|---|---|---|---|
| 3,300,995 | 1/1967 | McGrath | 62/500 X |
| 4,840,042 | 6/1989 | Ikoma et al. | 62/500 X |

*Primary Examiner*—Lloyd L. King

*Attorney, Agent, or Firm*—Frank R. Thienpont

[57] ABSTRACT

A vapor compression type refrigerator system which utilizes a liquid pump and an eductor to reduce compressor power conmsumption and thereby achieve exceptionally high coefficient performance values. The system is useful for air conditioning or for refrigeration in residential and commerical type buildings and is convertible to heat pump operation.

9 Claims, 3 Drawing Sheets

AIR CONDITIONING AND HEAT PUMP SYSTEM

This invention relates generally to vapor compression refrigerator systems utilized for air conditioning and more particularly to improved means for reducing power consumption of motor driven compressors conventionally utilized therein.

In typical prior art air conditioning refrigeration systems, refrigerant vapor is drawn from an evaporator coil and compressed to a high pressure and corresponding high temperature by a motor driven compressor which then forces the refrigerant through a condenser coil for heat exchange to the ambient air or other cooling medium. In the initial stages of the condenser coil, the super heated vapor cools to a saturated state following which condensation is initiated. The mass fraction of the vapor in the refrigerant mixture gradually decreases until condensation is completed and the refrigerant exits from the condenser as a liquid. The condensing refrigerant maintains a temperature sufficiently higher than the ambient atmosphere or other cooling medium to effect the required heat transfer to the cooling medium while passing through the condenser.

The compressor produces a vapor discharge pressure equal to the saturation pressure of the refrigerant which is determined by the condensing temperature. A large amount of energy is expended by the compressor in forcing the refrigerant vapor against the pressure head that exists between the suction and discharge sides of the compressor. In a motor driven compressor this accounts for about 90% of the total energy consumption of the refrigeration unit. Liquid refrigerant discharged from the condenser is throttled through an expansion valve or capillary tube into an evaporator coil from which it is returned to the compressor for successive cycles of operation.

BRIEF SUMMARY OF THE INVENTION

The present invention is directed to an improved system for reducing the energy consumed by the compressor in a conventional vapor compression refrigeration system. This reduction in energy consumption is carried out by incorporating an eductor and a refrigerant pump into the system such that the compressor discharges super heated vapor into a mixing zone of the eductor through which liquid refrigerant also is discharged by a separate refrigerant pump. The liquid-vapor mixture exiting from the eductor enters the condenser where condensation occurs by heat rejection to the ambient atmosphere or other cooling medium. The condensed liquid refrigerant is drawn by the refrigerant pump and discharged as a compressed liquid, part of which flows through an expansion valve into an evaporator coil and the remainder of which flows directly through the eductor. According to the present invention the condensing pressures and temperatures are considerably lower than those occurring in conventional prior art refrigeration units of this type. This is made possible by a reduction of thermal resistance on the refrigerant side of the condenser coil. In prior art units the refrigerant mass flow rate through the condenser coil is the same as that through the compressor while in the present invention the mass flow rate through the condenser is much greater than that passing through the compressor. This higher mass flow rate along with the lower average value of refrigerant quality, (i.e., mass fraction of vapor in the mixture) account for the reduction in thermal resistance and reduced power consumption by the compressor according to this invention.

It is a primary object of this invention to provide an improved vapor compression type air conditioning system for residential and commercial use.

It is another important object of this invention to provide an improved vapor compression type air conditioning system which is characterized by higher values of coefficient of performance and energy efficiency ratios.

It is still another important object of this invention to provide an improved refrigerating system for utilization in vapor compression type air conditioners in which compressor power consumption is materially reduced.

It is a still further object of this invention to provide an improved vapor compression type refrigeration system which is productive of longer life for the system's compressor due to marked reduction in compressor discharge pressures and temperatures.

Having described this invention the above and further objects, features and advantages thereof will be apparent to those familiar with the art from the following detailed description of preferred and modified embodiments thereof, illustrated in the accompanying drawings and constituting the best mode presently contemplated for enabling those of skill in the art to practice this invention.

IN THE DRAWINGS

Description of the Preferred Embodiment

Figure 1:
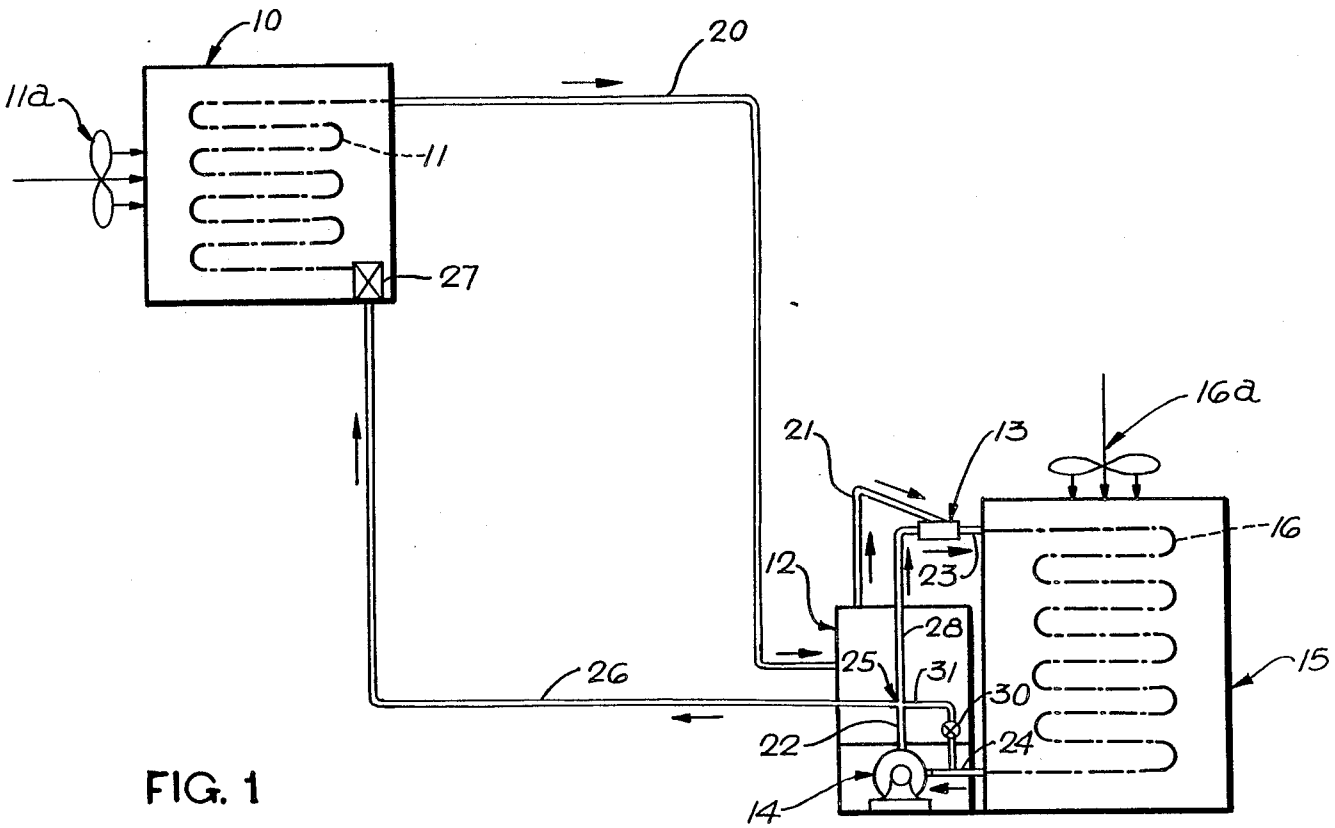
FIG. 1 is a schematic illustration of a refrigerator system according to this invention.

With particular reference to FIG. 1 of the drawings, the high performance air conditioning system of the present invention is illustrated as comprising an air cooled evaporator 10 with heat exchanging coil 11 and accompanying fan indicated at **11*a*, a vapor compressor 12, an eductor 13, a refrigerant pump 14, and condenser 15 having a heat exchanging coil 16 and air mover 16*a***, all in closed circuit relation.

The low pressure, low temperature refrigerant/vapor which is discharged from the coil of evaporator 10 is drawn to the suction side of compressor 12 through suitable tubing 20. After compression, super heated vapor discharged by the compressor 12 flows through tubing 21 into the mixing zone of eductor 13 where it is mixed with liquid refrigerant discharged by pump 14 via tubing sections 22 and 28.

The two phase (vapor and liquid) refrigerant mixture exiting from the eductor 13 flows through tubing 23 to an air cooled coil 16 of condenser 15 which serves to transfer heat to the outside air and produce a sub-cooled liquid refrigerant which is discharged through tubing 24 to the intake of pump 14.

The refrigerant pump discharges pressurized refrigerant through tubing 22 which is cross connected at 25 with tubing 26 leading to an expansion valve 27 communicating with the inlet side of coil 11 in evaporator 10. The portion of the discharge from pump 14 which flows to the evaporator is determined by the opening of the expansion valve 27. The remainder of the refrigerant discharged by pump 14 flows through the cross connect 25 to the inlet side of eductor 13 via tubing 28.

A pressure relief valve 30 may be provided as a precautionary feature in a by-pass conduit 31 arranged between the condenser discharge tubing 24 and the cross connect 25. The presence of the pressure relief valve 30 prevents accidental build up of excess pressures in the evaporator infeed tubing 26 as may occur from high ambient temperatures during stand by periods. Pressure relief valve 30 is set to open at prescribed values of differential pressures between the refrigerant in the condenser and that in evaporator tubing 26.

Preferably the refrigerant pump 14 is driven off the compressor shaft and is enclosed within the compressor housing thereby eliminating the need for expensive seals around the drive shaft for pump 14. As an option, pump 14 may be connected by a magnetic coupling with the compressor shaft or driven by a separate motor and located externally of the compressor housing.

Figure 2:
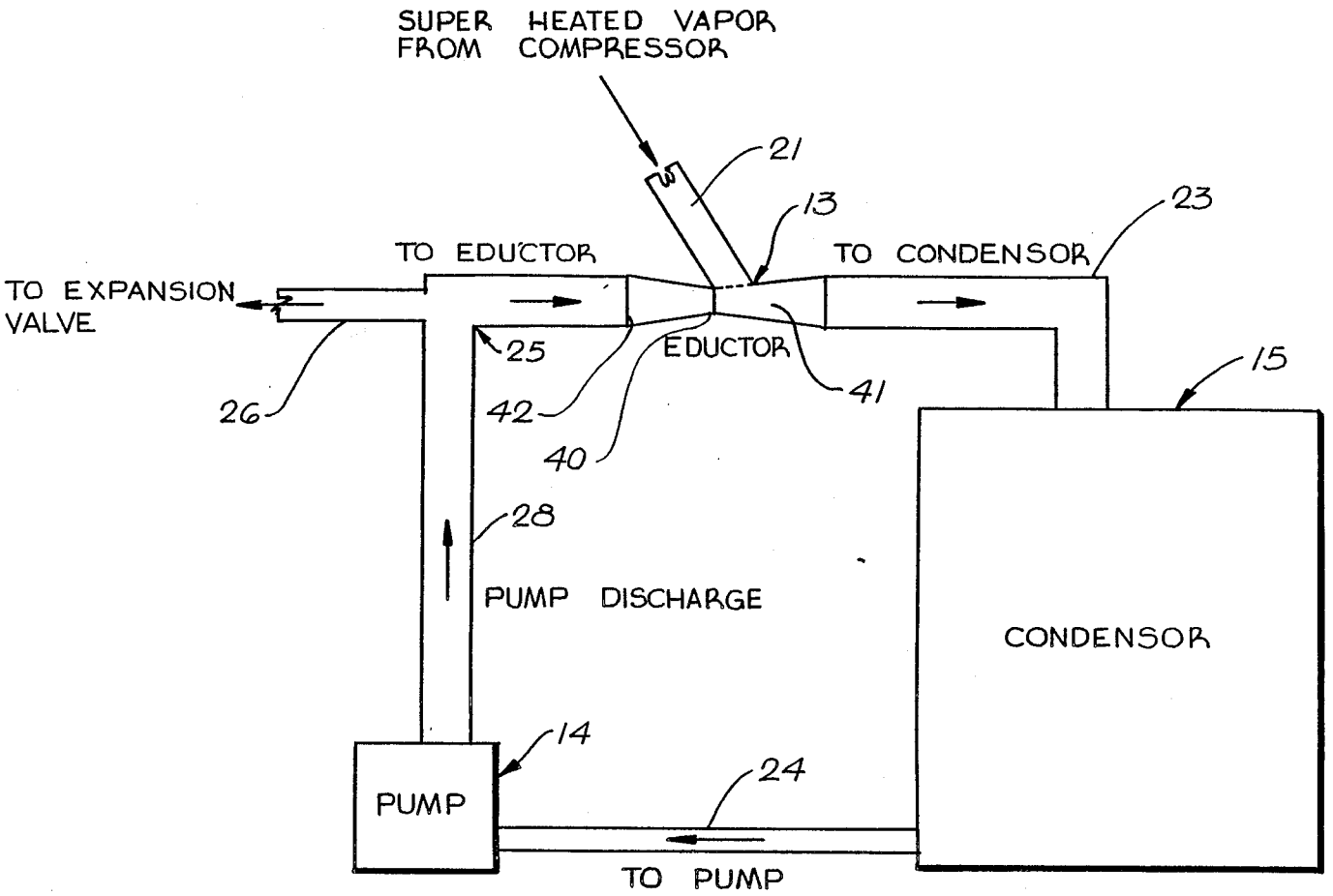
FIG. 2 is an enlarged schematic drawing of the eductor, condenser, and refrigeration pump circuit employed in the refrigeration system of FIG. 1.

Turning now to FIG. 2 of the drawings, features of the eductor loop comprising the refrigerant pump 14, the eductor 13, condenser 15 and interconnecting tubing circuit will now be described in greater particular.

As noted heretofore, in operation of the system illustrated in FIG. 1, the portion of refrigerant which flows through the evaporator is returned to the compressor which discharges directly into the mixing zone of the eductor for another cycle of operation. The portion of the discharge from pump 14 that flows directly to the inlet side of the eductor flows through a shorter loop consisting of the pump, the eductor and the condenser to by-pass the evaporator and compressor. Typically about 30% of the mass flow of refrigerant flowing through the condenser flows through the evaporator and the compressor while the remainder (approximately 70%) flows over the shorter loop depicted in FIG. 2 of the drawings.

By way of example of its operational functioning (utilizing refrigerant 22), on a typical 90° F. temperature day, liquid refrigerant flows from the condenser coil is at a temperature of approximately 100° F. and a pressure of approximately 195 psig. Such liquid refrigerant is discharged by pump 14 into the tubing or conduit 28 at substantially the same temperature, but at a slightly elevated pressure of about 225 psig. As noted heretofore, approximately 30% of the pumped refrigerant flows toward the expansion valve 27 and the evaporator 10 via tubing 26 while the remainder thereof enters the eductor 13 which includes a restrictive throat 40 leading to an expansion or mixing chamber 41 thereof (FIG.2). As a general rule it is preferred that the diameter of the restricting throat 40 of the eductor be substantially 30–35% of the diameter of the inlet opening 42 thereof which is joined directly to tubing 28 and the discharge side of pump 14.

As mentioned the discharge side of the compressor 12 is connected directly to the mixing chamber 41 of the eductor via tubing 21 so that the super heated vapor discharged from the compressor meets the liquid refrigerant issuing from the eductor throat 40 thereby mixing the hot vapor with the cooler liquid refrigerant. As a consequence, in the mixing zone of the eductor the super heated vapor is partially condensed and the released enthalpy causes the liquid temperature in the mixing chamber 41 to rise by a few degrees (to approximately 108° F.). The liquid-vapor mixture issuing from the mixing chamber 41 enters the condenser via conductor conduit 23 with a quality (mass fraction of vapor) of approximately 30%, a temperature in the neighborhood of 108° F. and at a pressure of roughly 220 psig. Typically a pressure drop of about 24 psi and a temperature drop of approximately 8° F. takes place in the condenser coil.

By way of comparison, corresponding knows systems of the prior art would experience a pressure drop of approximately 40 psi and temperature drop of 70° F. across the condenser. In such prior known units the initial turns of of the condenser coils account for the major portion of the pressure drop due to the high flow velocities of the super heated vapor entering the condenser coil.

In the system of this invention, because of the low quality (i.e., mass fraction of vapor) and the large mass flow rate of refrigerant in the condenser coil, the convection heat transfer coefficient on the refrigerant side remains high over the entire length of the coil. Therefore, the condenser fin temperature approaches that of the refrigerant making it possible to achieve a required rate of heat transfer from the condenser coil at lower values of refrigerant temperature as compared to those of the prior art.

Of additional consequence to the overall efficiency of the improved refrigerating system herein set forth, it is to be recognized that conventional residential central air conditioning units, for example, normally use a ⅜" 0.D. (approximately 5/16" I.D.) tubing for the condenser coil. Preferably the condenser coil 16 of condenser 15 under this invention is of slightly larger diameter, such as a ½" 0.D. which serves to limit the pressure drop across the condenser to about 20 psi. Conventional known units may not use this larger diametered tubing for the condenser coil as it adversely affects the heat transfer coefficient on the refrigerant side. The larger diametered tubing in the condenser coil according to loss of heat transfer capability inasmuch as the mass flow rate through the condenser coil is much higher and the average value of the refrigerant quality is lower than encountered in presently known conventional vapor compression refrigerating systems.

Additionally, the condenser of the present invention preferably uses a fan of approximately two times the volume capacity (cubic feet per minute of air) of a comparable existing unit. This is necessary due to the smaller temperature rise of the air flowing over the condenser coil. However, this does not increase the energy consumption of the unit significantly as the fan energy accounts for only about 6% of the energy consumption of the entire unit.

By way of illustration of the improved efficiency of this invention, typical values of comparative system temperatures and pressures for a 2.5 ton residential type central air conditioner using refrigerant 22 on a 90° F. temperature day are listed below:

| | Conventional Unit | Invention System |
|---|---|---|
| Condensing Temperature | 126° F. | 108° F. |
| Compressor Discharge Pressure | 285 psig | 220 psig |
| Condensing Pressure | 280 psig | 220 psig |
| Evaporator Pressure | 70 psig | 70 psig |
| Pressure Head Across Compressor | 215 psi | 150 psi |

-continued

| | Conventional Unit | Invention System |
|---|---|---|
| Temp. of Superheated Vapor | 180° F. | 152° F. |

Typical values of pump pressures on a 90° F. temperature day, will be about 195 psig on the inlet side and about 225 psig on the outlet side.

With references to FIGS. 3 and 4 of the drawings the adaptation of the present system to cooling/heat pump operation will now be described.

As is well recognized, a heat pump is functionally the opposite of an air conditioner. That is to say, in an air conditioner, refrigerant absorbs heat from the room air (lower temperature environment) moving over the evaporator coils and rejects heat to the outside air (higher temperature environment) moving over the condenser coils. The evaporator and condenser are both heat exchange devices In winter time if the rolls of the condenser and evaporator are reversed, i.e., if the refrigerant absorbs heat from the cool outside air (lower temperature environment) flowing through the condenser coils, which now functions as the evaporator, and rejects heat to the room air (higher temperature environment) while flowing through the evaporator coil, which now functions as the condenser, the unit becomes a heat pump.

Figure 3:
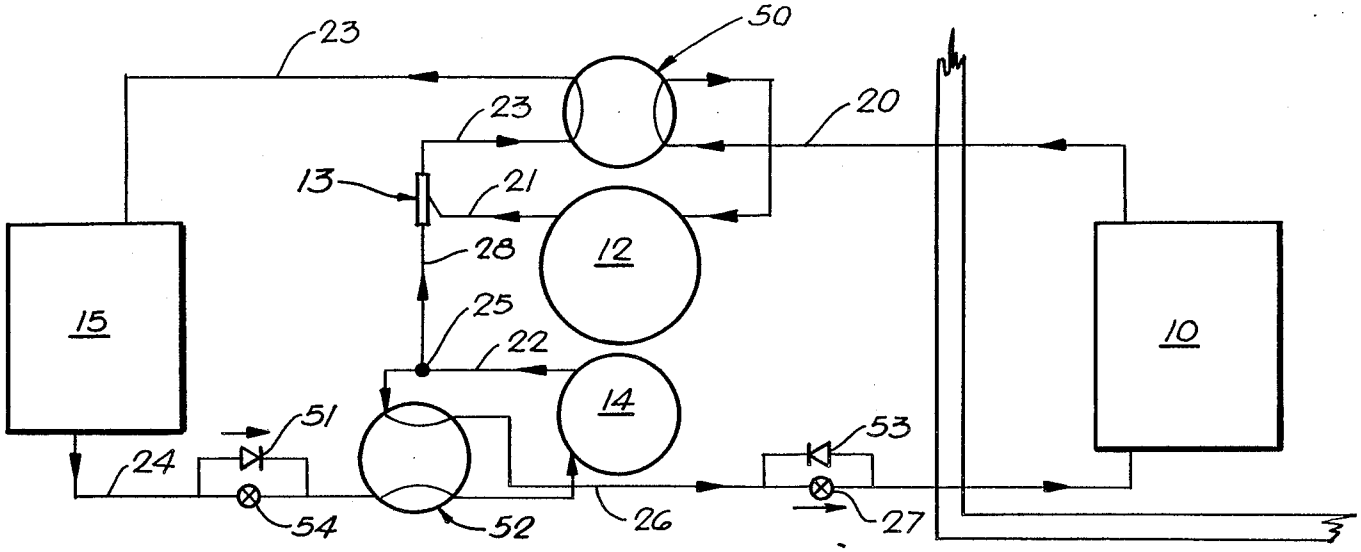
FIG. 3 is a schematic illustration of the adaptation of the present invention to heat pump operation showing the same arranged in a cooling cycle mode.

Application of the present invention cooling cycle operation is schematically illustrated in FIG. 3.

During the cooling cycle mode of operation as shown in FIG. 3 the compressor 12, as indicated by the arrows, discharges super heated vapor via conduit or tubing 21 into the mixing zone of the eductor 13 where it mixes with the liquid refrigerant discharged from the refrigerant pump 14 via the discharge conduits 22 and 28. The low quality two-phase refrigerant issuing from the eductor 13 flows via the discharge conduit 23 to a first four way valve 50 which is conditioned to direct the eductor discharge to the condenser 15. The condensed, slightly sub-cool refrigerant exiting from the condenser flows via conduit 24 through a first by pass valve 51 to a second four way valve 52 which directs it to the suction side of the refrigerant pump 14. A fraction of the refrigerant discharged by the pump 14 flows through the conduit 22 and junction 25 to the second four way valve 52 which then directs the liquid refrigerant through conduit 26 to the expansion valve 27 and the intake side of the evaporator 10. The cool, low pressure vapor exiting from the evaporator flows through conduit or tubing 20, to the first four way valve 50 and back to the suction side of the compressor 12. It will be recognized that the schematic showing of FIG. 3 corresponds to the refrigerating system illustrated in FIG. 1 of the drawings.

Figure 4:
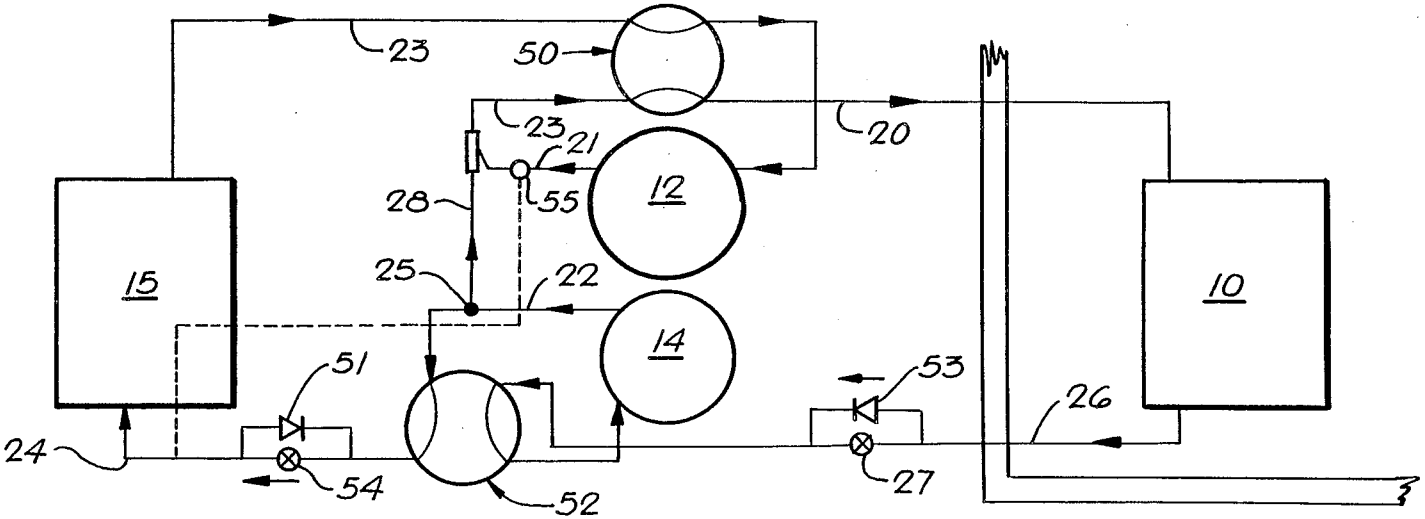
FIG. 4 is a schematic illustration similar to FIG. 3 illustrating the heat pump operation of this invention during a heating cycle.

In FIG. 4 of the drawings the system is adapted to heating cycle mode of operation during which the compressor 12 discharges into the mixing chamber of eductor via conduit 21 13 as in the cooling mode described so that the high temperature vapor compressor discharge mixes with liquid refrigerant discharged by the refrigerant pump 14 via conduit 22, junction 25 and conduit 28. The low quality, two-phase refrigerant issuing from the eductor flows through conduit 23 and the first four way valve 50, now conditioned to direct such flow into the condenser 10 via conduit 20. From the condenser, the liquid returns to the refrigerant pump 14 through conduit 26, a second by pass valve 53 (by passing now closed expansion valve 27), and the second four way valve 52 to the intake side of the liquid pump 14. A fraction of the liquid refrigerant discharged by pump 14 flows through conduit 22 and junction 25 to the evaporator 15 via conduit 24, the second four way valve 52 and the now opened second expansion valve 54; the first by pass valve 51 being in a closed condition. The cool, low pressure vapor discharged from evaporator 15 returns to the compressor 12 through the first four way valve 50 and conduit 23.

An optional three way valve 55 may be placed on the discharge side of the compressor, i.e., in conduit 21. When open, valve 55 is used to reroute the hot vapor discharge of the compressor periodically into the evaporator for short time periods for the purpose of defrosting the evaporator coil during severe cold weather conditions.

From the foregoing it is believed that those familiar with the art will readily recognize and appreciate the novel concept and combination involved in the present invention and will appreciate that while the same is herein described in association with preferred and modified embodiments thereof, the same is, nevertheless susceptible to wide variation and substitution of equivalents without departing from the spirit and scope of the invention which is intended to be unlimited by the foregoing except as may appear in the following appended claims.

The embodiments of the invention in which an exclusive property or privilege is claimed are defined as follows:

1. A vapor compression type refrigerating system comprising:

a heat exchanging evaporator unit having an intake and a discharge, a compressor unit having an intake and a discharge, first conduit means coupling the discharge of said evaporator with the intake of said compressor, an eductor having an inlet, a restrictive throat, a mixing chamber and an outlet, second conduit means coupling the discharge of said compressor with the mixing chamber of said eductor, a condenser unit having an intake and a discharge, third conduit means coupling the discharge of said eductor with the intake of said condenser unit, a liquid refrigerant pump having an intake and a discharge, fourth conduit means coupling the intake of said pump with the discharge of said condenser unit; and means coupling the discharge of said pump with the inlet of said eductor and the intake of said evaporator whereby a minor portion of liquified refrigerant discharged from said condenser is pumped to said evaporator and a major portion thereof is pumped to the inlet of said eductor for mixture with high temperature and high pressure vapor discharged from said compressor whereby to reduce the load on said compressor.

2. The system of claim 1, and a regulatable expansion valve controlling the flow of liquid refrigerant to the intake of said evaporator.

3. The system of claim 1, wherein said evaporator unit circulates refrigerant through a heat exchanging coil, and air handler means for moving atmosphere to be cooled over said coil.

4. The system of claim 1, wherein said condenser unit has a heat exchanging coil, and air handler means for moving atmosphere over said coil.

5. The system of claim 1, and means for reversing the flow of refrigerant to and from said evaporator and condenser units whereby to convert the system to heat pump operation.

6. The system of claim 1, wherein said minor portion of said refrigerant is approximately 30% of the mass flow thereof through the condenser and said major portion is substantially 70% thereof.

7. In a vapor compression type refrigerating system having a pressure sealed refrigerant circuit comprising a heat exchanging evaporator, a compressor for compressing vaporized refrigerant discharged from the evaporator, and a heat exchanging condenser for liquifying pressurized refrigerant discharged by the compressor, the improvement comprising:

an eductor in sealed circuit relation with the discharge of the compressor and the intake of the condenser, said eductor having an intake, a restrictive throat leading to a mixing chamber, and an outlet;

means for introducing vaporized refrigerant discharged from the compressor directly into the mixing chamber of said eductor;

a refrigerant pump, having an intake receptive of liquid refrigerant discharged from the condenser, and means for distributing a minor portion of said pump's liquid refrigerant output to the intake side of the evaporator and a major portion thereof to the intake of said eductor, such that the vaporized refrigerant discharged by the compressor is mixed with liquid refrigerant discharged by said pump prior to its introduction to said condenser whereby to significantly reduce the mass fraction of vapor and increase the mass flow rate of refrigerant treated by said condenser.

8. The improvement of claim 7, in which the eductor has a throat diameter of substantially 30–35% of said intake thereof.

9. The improvement of claim 7, and means for reversing the flow of refrigerant through the evaporator and condenser to convert the system to heat pump operation.

* * * * *